US009682583B2

(12) United States Patent
Seino et al.

(10) Patent No.: US 9,682,583 B2
(45) Date of Patent: Jun. 20, 2017

(54) CONTROL METHOD FOR LIQUID EJECTING SYSTEM AND LIQUID EJECTING SYSTEM

(71) Applicant: SEIKO EPSON CORPORATION, Tokyo (JP)

(72) Inventors: Takeo Seino, Matsumoto (JP); Nobutada Mizusawa, Sapporo (JP)

(73) Assignee: Seiko Epson Corporation, Tokyo (JP)

( * ) Notice: Subject to any disclaimer, the term of this patent is extended or adjusted under 35 U.S.C. 154(b) by 18 days.

(21) Appl. No.: 14/341,660

(22) Filed: Jul. 25, 2014

(65) Prior Publication Data

US 2015/0029249 A1 Jan. 29, 2015

(30) Foreign Application Priority Data

Jul. 26, 2013 (JP) ..... 2013-155349

(51) Int. Cl.

*B41J 29/393* (2006.01)
*B41J 2/165* (2006.01)
*B41J 29/13* (2006.01)

(52) U.S. Cl.

CPC ..... *B41J 29/393* (2013.01); *B41J 2/165* (2013.01); *B41J 2/16579* (2013.01); *B41J 29/13* (2013.01); *B41J 2002/16573* (2013.01)

(58) Field of Classification Search

USPC ..... 347/5, 9, 17, 1, 24, 23, 19
See application file for complete search history.

(56) References Cited

U.S. PATENT DOCUMENTS 5,485,286 A * 1/1996 Ejiri ..... H04N 1/32793 347/23
6,536,866 B1 * 3/2003 Uchikata ..... B41J 2/165 347/23
6,565,179 B1 5/2003 Bruch et al.
8,628,164 B2 * 1/2014 Murase ..... H04N 1/00015 347/19
2007/0070095 A1 * 3/2007 Baek ..... B41J 29/38 347/5
2008/0007587 A1 * 1/2008 Watanabe ..... 347/19
2009/0073201 A1 3/2009 Watanabe et al.

(Continued)

FOREIGN PATENT DOCUMENTS

JP 2000-238274 9/2000
JP 2005-231249 9/2005

(Continued)

*Primary Examiner* — Lam Nguyen
(74) *Attorney, Agent, or Firm* — Workman Nydegger

(57) ABSTRACT

A control method for a liquid ejecting system provided with a liquid ejecting apparatus including a liquid ejecting portion for ejecting a liquid and an inputting apparatus including a data inputting portion through which data can be inputted includes a specific data detecting process that detects whether or not input data inputted to the data inputting portion is specific data which is other than liquid ejection data for causing a liquid corresponding to an image to be formed on an ejection target medium to be ejected from the liquid ejecting portion and which is determined in advance as data for prompting an ejection inspection; and a nozzle inspecting process that, in the case where the specific data is detected in the specific data detecting process, causes a nozzle inspecting portion to perform the ejection inspection.

14 Claims, 5 Drawing Sheets

(56) References Cited

U.S. PATENT DOCUMENTS

| | | | |
|---|---|---|---|
| 2009/0091779 | A1 | 4/2009 | Ishinaga et al. |
| 2011/0115841 | A1 | 5/2011 | Ito |
| 2012/0242733 | A1 | 9/2012 | Ishinaga et al. |
| 2013/0147869 | A1 | 6/2013 | Ito |
| 2014/0071193 | A1 | 3/2014 | Ito |

FOREIGN PATENT DOCUMENTS

| | | |
|---|---|---|
| JP | 2007-160916 | 6/2007 |
| JP | 2009-190284 | 8/2009 |
| JP | 2011-104803 | 6/2011 |
| JP | 2012-061847 | 3/2012 |

* cited by examiner

CONTROL METHOD FOR LIQUID EJECTING SYSTEM AND LIQUID EJECTING SYSTEM

BACKGROUND

1. Technical Field

The present invention relates to a control method for a liquid ejecting system including a liquid ejecting apparatus for ejecting liquid and an input apparatus for inputting data, as well as a liquid ejecting system.

2. Related Art

Recently, it has become popular to, in a printer as a liquid ejecting apparatus, form (print) images (moving images, still images and the like) photographed by using, for example, a digital camera, or the like, on an ejection target medium, such as print paper, by ejecting liquids onto the ejection target medium through a plurality of nozzles included in a liquid ejecting head. At this time, in order that images are correctly printed on the ejection target medium, it is necessary that each of the nozzles for ejecting liquids is in the state capable of ejecting the liquid correctly. For this reason, in existing printers, a nozzle inspection (a dot-missing inspection) for inspecting whether or not each of nozzles is in the state capable of ejecting a corresponding liquid is performed, and as a result of the nozzle inspection, in the case where any dot-missing nozzle is detected, a maintenance of a liquid ejecting head is performed by making cleaning of the nozzle (refer to, for example, JP-A-2005-231249).

Meanwhile, in existing printers, the timing of making cleaning (performing maintenance) of such a dot-missing nozzle having been detected through the nozzle inspection is made a timing point after the completion of transmission of data (liquid ejection data), which is for use in ejecting liquid droplets associated with an image to be printed on an ejection target medium through nozzles, to the printer from, for example, a personal computer. That is, in existing printers, the cleaning of nozzles is made under the state where printing is assuredly performed after the completion of transmission of liquid ejection data to the printer functioning as a liquid ejecting apparatus from a personal computer functioning as an inputting apparatus for inputting data associated with an image to be printed. In this way, in such a printer, the consumption of liquids is suppressed so as not to be wasted.

Nevertheless, in such a case where the cleaning (maintenance) of nozzles is made (performed) after the completion of transmission of liquid ejection data to a printer, there is a problem that it takes a long time from the beginning of inputting of data associated with a printing image in a personal computer until the beginning of execution of ejection of liquids. For this reason, when a user performs printing of a desired image by using a kiosk terminal installed at a shop, this kiosk terminal being an example of the inputting apparatus and the liquid ejecting apparatus, the user needs to wait for a long time from the beginning of inputting of data until the completion of printing of the image, at the shop where the kiosk terminal is installed.

In addition, such a situation has been generally common to liquid ejecting systems each provided with a liquid ejecting apparatus that includes a liquid ejecting portion including a plurality of nozzles, a nozzle inspecting portion for inspecting whether or not the nozzles are in the state capable of ejecting liquid droplets correctly, and a maintenance portion for performing maintenance, as well as an inputting apparatus that receives data inputted by a user.

SUMMARY

An advantage of some aspects of the invention is to provide a control method for a liquid ejecting system and a liquid ejecting system which make it possible to shorten a required time from the beginning of a user's input of data in an inputting apparatus until the beginning of ejection of a liquid in a liquid ejecting apparatus.

A control method for a liquid ejecting system, according to an aspect of the invention, is for use in a liquid ejecting system provided with a liquid ejecting apparatus including a liquid ejecting portion that includes a plurality of nozzles through each of which a liquid is ejected, a nozzle inspecting portion that performs an ejection inspection for inspecting whether or not the nozzles are in a state capable of ejecting liquid droplets correctly, and a maintenance portion that performs maintenance of the nozzles, and an inputting apparatus including a data inputting portion through which data can be inputted, and includes a specific data detecting process that detects whether or not input data inputted to the data inputting portion is specific data which is other than liquid ejection data for causing a liquid corresponding to an image to be formed on an ejection target medium to be ejected from the liquid ejecting portion, and which is determined in advance as data for prompting the ejection inspection; and a nozzle inspecting process that, in the case where the specific data is detected in the specific data detecting process, causes the nozzle inspecting portion to perform the ejection inspection. Further, the control method according to the first aspect of the invention further includes a maintenance process that, in accordance with a state of the nozzles which is detected in the nozzle inspecting process, causes the maintenance portion to perform maintenance of the nozzles.

According to this method, it becomes possible to shorten a required time from the beginning of a user's access to the data inputting apparatus (for example, a user's insertion of a recording medium into the data inputting portion, or the like) until the beginning of ejection of the liquid in the liquid ejecting apparatus, as compared with a case where the nozzle inspecting portion performs a nozzle inspection after the completion of transmitting the liquid ejection data to the liquid ejecting apparatus.

Preferably, the aforementioned control method for a liquid ejecting system further includes a designated data detecting process that detects whether or not input data inputted to the data inputting portion is designated data which is determined in advance as data for which a probability that the liquid for use in forming the image on the ejection target medium is ejected from the liquid ejecting portion is relatively high among a plurality of pieces of specific data including the specific data, and in the case where the designated data is detected in the designated data detecting process, the maintenance process is performed.

According to this method, the execution of a waste maintenance is suppressed by defining, as designated data, input data for which a probability that the liquid is actually ejected from the liquid ejecting portion onto the ejection target medium in the liquid ejecting apparatus is high, and performing maintenance in the case where this designated data has been inputted. As a result, it becomes possible to reduce an amount of a liquid consumed in the maintenances.

In the aforementioned control method for a liquid ejecting system, preferably, the designated data is data for use in setting a specification of the ejection target medium.

According to this method, through such a way that, in the case where the number of nozzles incapable of ejecting is small, the maintenance is not performed immediately and is performed when data for use in setting a specification of the ejection target medium has been inputted, it becomes possible to reduce an amount of a liquid consumed in the maintenances, and further, it becomes possible to shorten a required time from the beginning of a user's access to the data inputting apparatus until the beginning of ejection of the liquid in the liquid ejecting apparatus.

In the aforementioned control method for a liquid ejecting system, preferably, the designated data is elapsed time data which indicates an elapsed time from a time point when the specific data is detected, and which is determined in accordance with a state of the nozzles inspected in the nozzle inspecting process.

According to this method, for example, in a case where the number of nozzles each incapable of ejecting is small and it is unnecessary to immediately perform maintenance, or the like, the maintenance is performed after an elapsed time which is determined in accordance with a state of nozzles which has been detected through the nozzle inspection. Accordingly, it becomes possible to reduce an amount of inks consumed in the maintenances.

Preferably, the aforementioned control method for a liquid ejecting system further includes a medium transporting process that, before the nozzle inspecting process is performed, causes a transporting portion, which is further included in the liquid ejecting apparatus and which transports an ejection target medium onto which the liquid ejecting portion ejects the liquid, to transport the ejection target medium.

According to this method, even when there occurs a state where the ejection of the liquid through the nozzles is blocked due to the transportation of the ejection target medium (for example, a state where paper powder or the like is adhered to the nozzles), it is possible to perform maintenance of such nozzles each being in the state incapable of ejecting the liquid onto the ejection target medium by performing the nozzle inspection after the completion of the transportation of the ejection target medium.

Preferably, the aforementioned control method for a liquid ejecting system further includes a data transmitting process that transmits liquid ejection data for causing the liquid to be ejected, to the liquid ejecting apparatus, and the maintenance process is performed before the data transmitting process is performed.

According to this method, the maintenance is performed during a period from the beginning of a user's access to the data inputting portion for inputting data in the inputting apparatus until the beginning of ejection of the liquid in the liquid ejecting apparatus, and thus, it becomes possible to shorten a required time before the beginning of the ejection of the liquid.

A liquid ejecting system according to another aspect of the invention includes a liquid ejecting apparatus that includes a liquid ejecting portion including a plurality of nozzles through each of which a liquid is ejected, a nozzle inspecting portion that inspects whether or not the nozzles are in a state capable of ejecting liquid droplets correctly, and a maintenance portion that performs maintenance of the nozzles; an inputting apparatus that includes an inputting portion through which data can be inputted; and a controlling apparatus that includes a data detecting portion that detects whether or not input data inputted to the data inputting portion is predetermined specific data, and an execution control portion that, in the case where the data detecting portion detects the specific data, causes the nozzle inspecting portion to perform an inspection, and causes the maintenance portion to perform maintenance of the nozzles in accordance with a state of the nozzles which is detected by the nozzle inspecting portion.

According to this liquid ejecting apparatus configured in such a way as described above, it becomes possible to shorten a required time from the beginning of a user's access to the data inputting apparatus (for example, a user's insertion of a recording medium into the data inputting portion, or the like) until the beginning of ejection of the liquid in the liquid ejecting apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting system will be described with reference to the drawings.

Figure 1:
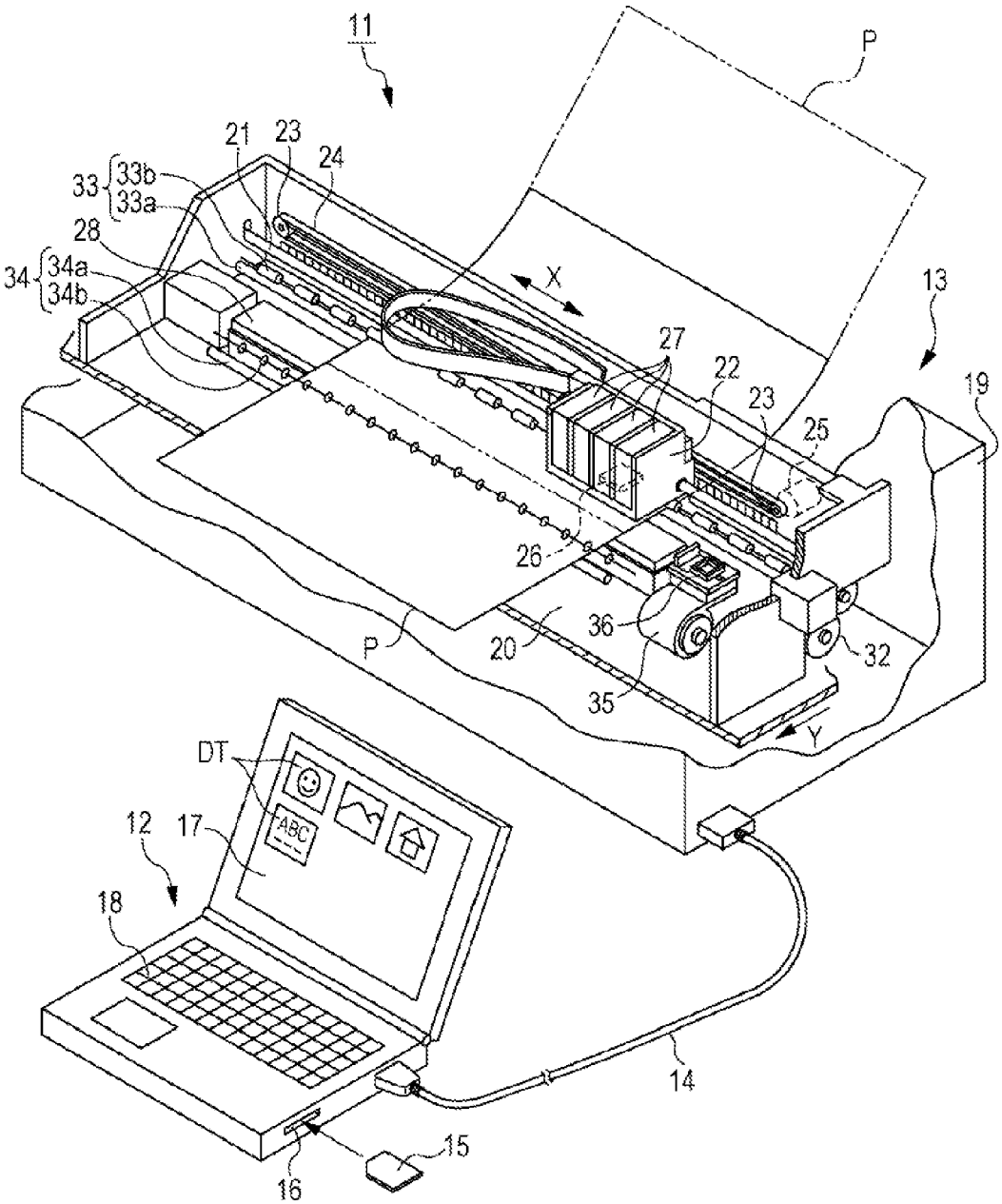
FIG. 1 is a perspective view diagram illustrating an outline of a configuration of a liquid ejecting system according to an embodiment of the invention.

As shown in FIG. 1, a liquid ejecting system according to this embodiment includes a personal computer (hereinafter, referred to as a "PC") which is an example of an inputting apparatus, and an ink jet printer (hereinafter, referred to as just a "printer") which is an example of a liquid ejecting apparatus. In this embodiment, a PC 12 and a printer 13 are provided in their respective own housings, and are connected to each other via a connection cable 14, such as a USB cable, so as to be mutually communicable through electric signals. In addition, the liquid ejecting system 11 may have a unified structure in which the PC 12 and the printer 13 are provided in a single housing.

The PC 12 includes a slot 16 in which a recording medium 15, such as a memory card, recording text data and/or image data (collectively referred to as image data) therein can be inserted, and through this insertion of the recording medium 15 into the slot 16, the image data is read into the PC 12. The read-in image data is displayed on a display unit 17 of the PC 12 in the form of display images DT, such as thumbnail-size images, and when a user operates operation keys 18, such as key buttons, various pieces of data relating to printing are inputted to the PC 12 for each of the display images DT. The inputted various pieces of data are stored in the PC 12 so as to be correlated with each of the display images DT. Accordingly, the PC 12 functions as an inputting apparatus including the operation keys 18 and the slot 16, these components being examples of components included in the inputting portion through which data can be inputted.

The printer 13 includes a body frame 20 inside an approximately rectangular box-shaped apparatus body 19 provided with openings at its upper and front sides, and a guide shaft 21 of a given length is provided across between side walls disposed in the longitudinal direction of the frame body 20. This guide frame 21 is provided with a carriage 22 in the state capable of reciprocating in a main-scanning direction X which is the longitudinal direction of the guide frame 21. An endless timing belt 24 is wound and hang around a pair of pulleys 23 attached to the inner face of a back plate of the body frame 20, and the carriage 22 is fixed to a portion of the timing belt 24. A driving shaft (an output shaft) of a carriage motor 25 is joined with one of the pulleys 23, so that the timing belt 24 rotates in a normal/reverse direction in conjunction with the carriage motor 25 being driven in a normal/reverse direction, thereby causing the carriage 22 to reciprocate in the main-scanning direction X.

There is provided, under the carriage 22, with a liquid ejecting head 26, which is an example of the liquid ejecting portion that includes a plurality of nozzles through each of which a liquid is ejected. A plurality of (for example, four) ink cartridges 27 each containing a corresponding one of four color inks, such as a black (K) ink, a cyan (C) ink, a magenta (M) ink and a yellow (Y) ink, can be attached onto the carriage 22. Further, inks each fed from a corresponding one of the ink cartridges 27 are configured to be ejected through a plurality of nozzle rows which are arranged for each of the ink colors on a nozzle forming face (the lower face) of the liquid ejecting head 26. In addition, the number of the color inks the liquid ejecting head 26 is capable of ejecting is not limited to four, but may be one, two, three, five or more.

A support stand 28 for defining a gap between the liquid ejecting head 26 and print paper P, which is an example of the ejection target medium, is provided at a position below a movement path of the carriage 22 reciprocating in the main-scanning direction X, so as to extend in the main-scanning direction X similarly thereto. Further, while being supported by the support stand 28, the print paper P is passed through between the liquid ejecting head 26 and the support stand 28 and is transported in a sub-scanning direction Y perpendicular to the main-scanning direction X by a transporting unit driven by a transportation motor 32 provided in the body frame 20.

This transporting unit is configured to, in the sub-scanning direction Y which is a transportation direction of the print paper P, include a transportation roller pair 33 and an ejection roller pair 34 which are disposed at the upstream side and the downstream side, respectively, which interpose the support stand 28 therebetween. The transportation roller pair 33 includes a transportation driving roller 33*a* which is rotation-driven by power of the transportation motor 32, and a transportation driven roller 33*b* which abuts and rotates with the transportation driving roller 33*a*. Further, the ejection roller pair 34 includes an ejection driving roller 34*a* which is rotation-driven by power of the transportation motor 32, and an ejection driven roller 34*b* which abuts and rotates with the ejection driving roller 34*a*. Accordingly, the transportation motor 32 is rotation-driven and thereby the transportation driving roller 33*a* and the ejection driving roller 34*a* are driven, so that the print paper P, which is in the state of being nipped by the transportation roller pair 33 and the ejection roller pair 34, is transported in the sub-scanning direction Y.

The printer 13 performs printing of texts and/or images on the print paper P on the basis of liquid ejection data, which will be described below, by alternately repeating an ejection operation of ejecting inks onto the print paper P through the nozzles while reciprocating the carriage 22 in the main-scanning direction X, and a transportation operation of transporting the print paper P in the sub-scanning direction Y by a predetermined transportation amount. In this way, the printer 13 functions as the liquid ejecting apparatus.

In the printer 13 according to this embodiment, the transportation roller pair 33 and the ejection roller pair 34 which constitute the transporting unit are configured so as to be capable of being rotated by the transportation motor 32 so that the print paper P can be reverse-transported to the upstream side in the sub-scanning direction Y as shown in a chain double-dashed line in FIG. 1 after having been transported to the downstream side in the sub-scanning direction Y as shown in a full line in FIG. 1. In this way, in the case where the print paper P is, for example, roll paper resulting from winding long paper in a roll shape, an operation of feeding the print paper P to the liquid ejecting head 26 is performed so as to cause the leading edge of the print paper P in the sub-scanning direction Y to be detected by a sensor (not illustrated) or the like by transporting the print paper P once so as to cause the print paper P to pass through between the liquid ejecting head 26 and the support stand 28. Subsequently, an operation of transporting the detected leading edge of the print paper P in the sub-scanning direction Y to a predetermined printing start position relative to the liquid ejecting head 26 is performed by transporting the print paper P in a direction reverse to the sub-scanning direction Y.

Further, an end position on the movement path of the carriage 22 (in this case, a right end position when viewed in the direction reverse to the sub-scanning direction Y) is a home position where the carriage 22 waits ready when printing is not performed. A maintenance apparatus 35, which is an example of the maintenance portion, for performing maintenance including cleaning of nozzles with respect to the liquid ejecting head 26, is provided at a position right below the carriage 22 staying at the home position. The maintenance apparatus 35 includes a cap 36 which is capable of abutting the liquid ejecting head 26, for example, so as to enclose nozzles, and makes cleaning of the nozzles by reducing a pressure inside a space formed by the abutting of the cap 36 and causing an unnecessary ink left inside each of the nozzles to be ejected.

Moreover, in the printer 13, for each of the nozzles of the liquid ejecting head 26, an ejection inspection as to whether the nozzle is in the state capable of ejecting ink droplets (liquid droplets) correctly though itself, that is, a nozzle inspection, is performed. This nozzle inspection is performed such that, for example, the carriage 22 is caused to move to the home position in order to cause the liquid ejecting head 26 to face the cap 36, and a predetermined voltage is applied between the liquid ejecting head 26 and the cap 36 which are facing each other. It is possible to employ a method in which, under the state where this voltage is applied, the liquid ejecting head 26 performs operation of ejecting an ink through an inspection target nozzle predetermined times; a variation of a voltage value of the voltage being applied between the liquid ejecting head 26 and the cap 36 is detected; and thereby an ejection inspection as to whether or not the inspection target nozzle is in the state capable of ejecting ink droplets correctly is performed. That is, in the case where the variation of a voltage value of the applied voltage is more than or equal to a threshold value, this indicates that the ink droplets are correctly ejected, and it is detected that the inspection target nozzle is in the state capable of ejecting ink droplets correctly. Accordingly, in this case, at least a voltage detecting unit (not illustrated) for detecting a voltage value of the voltage applied between the liquid ejecting head 26 and the cap 36 functions as the nozzle inspecting unit (refer to FIG. 2).

Alternatively, it is possible to employ, as the nozzle inspection, a method in which, light rays are irradiated so as to intersect with flight trajectories of ink droplets ejected from an inspection target nozzle; a light receiving unit receives the irradiated light rays; and thereby a variation of an intensity of the received light rays is detected. That is, in the case where the variation of an intensity of light rays received by the light receiving unit is more than or equal to a threshold value, this indicates that the ink droplets are correctly ejected, and thus, it is detected that the inspection target nozzle is in the state capable of ejecting ink droplets correctly. Naturally, any other method capable of detecting that an inspection target nozzle is in the state capable of ejecting ink droplets correctly can be also employed.

Figure 2:
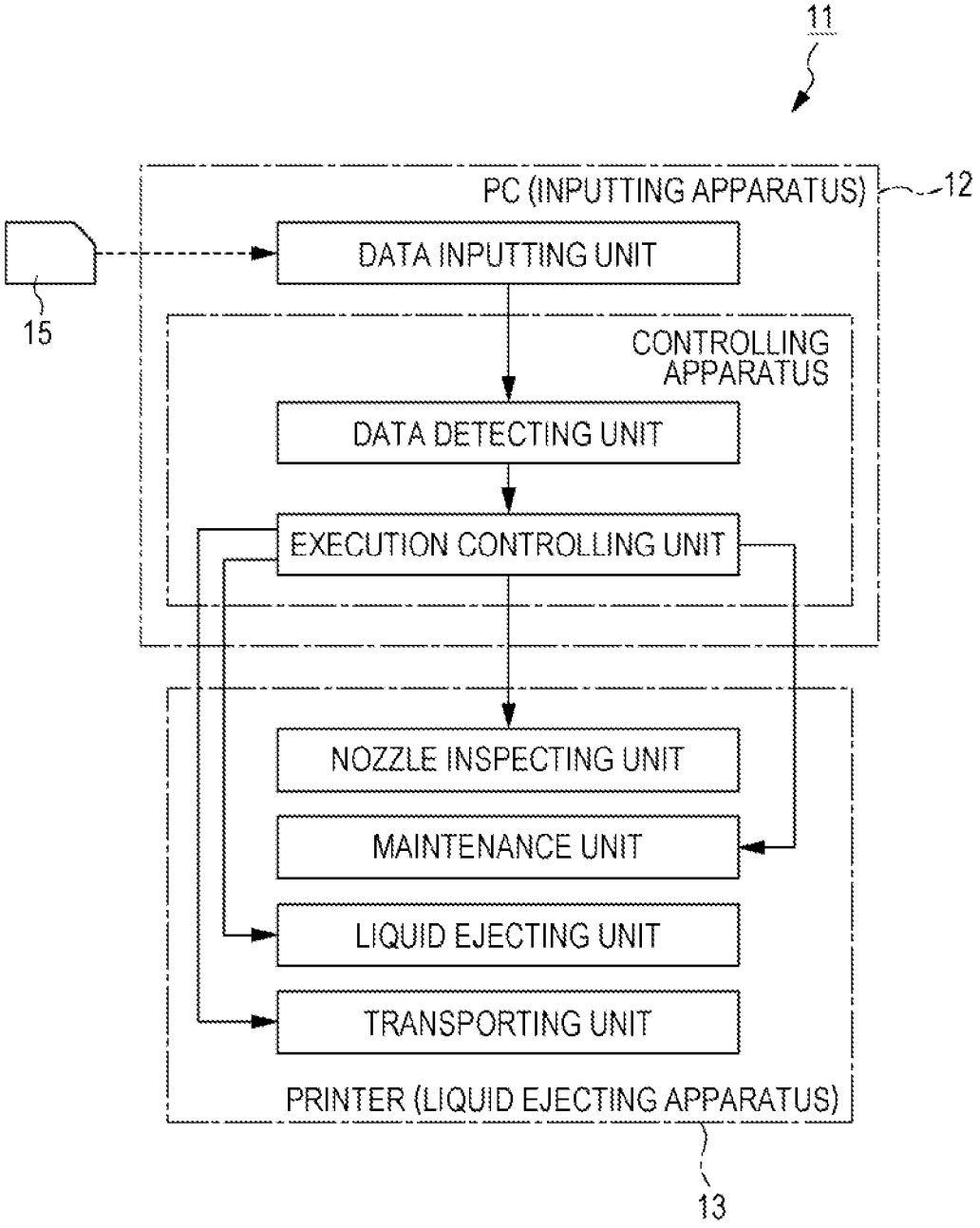
FIG. 2 is a function block diagram illustrating a functional configuration of a liquid ejecting system according to an embodiment of the invention.

As shown in FIG. 2, in this embodiment, for individual function units included in the above-described printer 13 (the liquid ejecting apparatus), that is, a liquid ejecting unit, the transporting unit, a maintenance unit and a nozzle inspecting unit, their respective executions of function operations are controlled by a controlling apparatus provided at the PC 12 (the inputting apparatus) side. That is, a control circuit (not illustrated), which is included in the PC 12 and is constituted of a central arithmetic operation element, a memory element and the like, functions as the controlling apparatus, and performs control of the individual function units of the printer 13. In addition, specific operations of the individual function units included in the printer 13 (the liquid ejecting apparatus), that is, specific operations of the liquid ejecting unit, the transporting unit, the maintenance unit and the nozzle inspecting unit, are performed by a control circuit (not illustrated) constituted of a central arithmetic operation element, a memory element and the like included in the printer 13 (the liquid ejecting apparatus). Accordingly, the controlling apparatus of the PC 12 performs control of the executions of operations of the individual function units by transmitting predetermined signals described below, such as a preparation command signal and a printing allowance/non-allowance selection signal (refer to FIG. 3), to the control circuit of the printer 13.

The controlling apparatus includes a data detecting unit and an execution controlling unit. The data detecting unit detects whether or not input data, which has been inputted to the data inputting unit (the slot 16 or the like) of the PC 12 via the recording medium 15 or the like, is predetermined data. The execution controlling unit performs control of an operation of each of the nozzle inspecting unit, the maintenance unit, the liquid ejecting unit and the transporting unit which are included in the printer 13. In this embodiment, the central arithmetic operation element included in the PC 12 operates in accordance with programs stored in the memory element included in the PC 12, and thereby the data detecting unit and the execution controlling unit perform their respective given processes.

Figure 3:
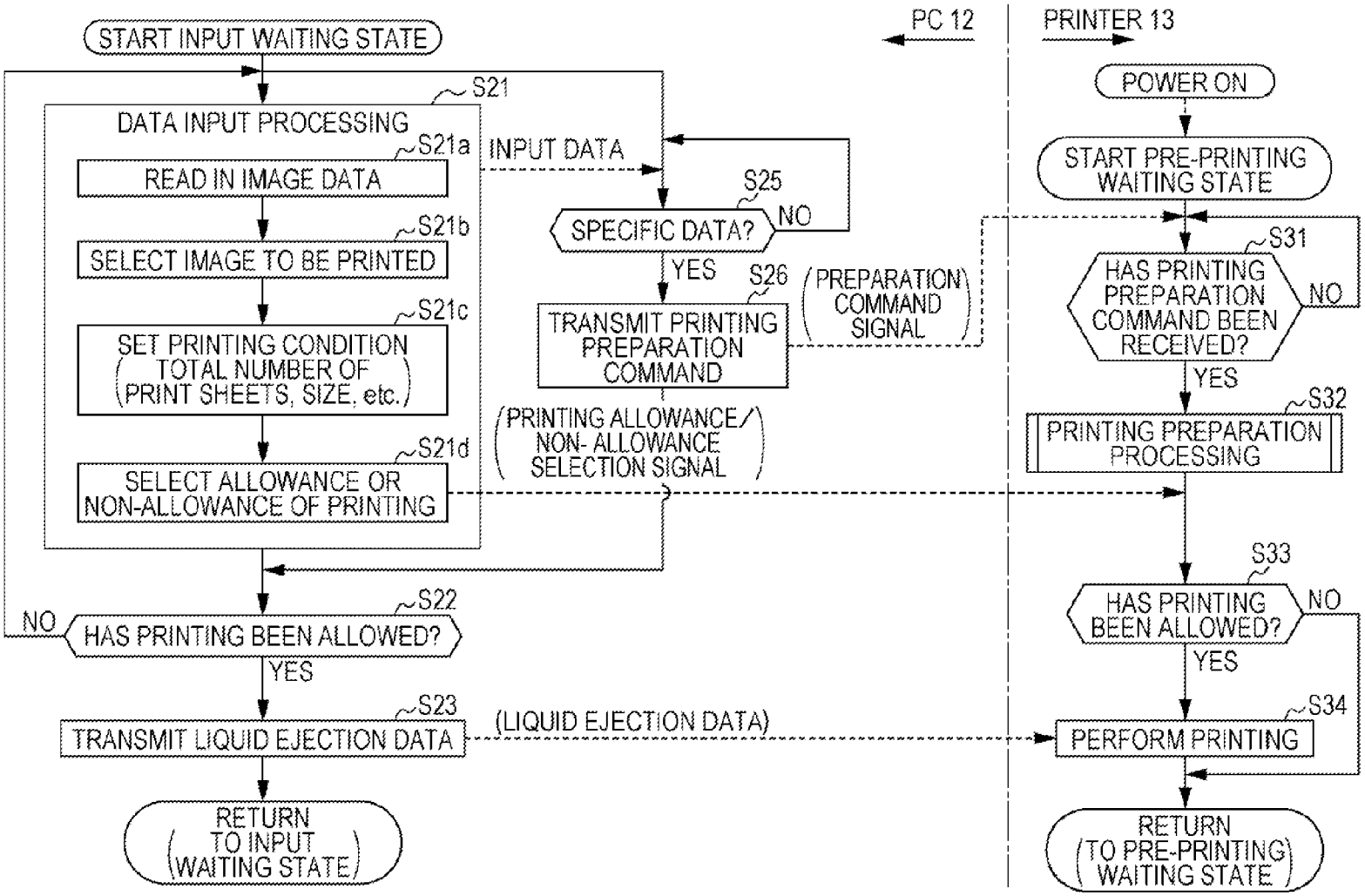
FIG. 3 is a flowchart illustrating processing for both an inputting apparatus and a liquid ejecting apparatus included in a liquid ejecting system according to an embodiment of the invention.

Specifically, the data detecting unit detects whether or not input data having been inputted to the data inputting unit is predetermined specific data (refer to FIG. 3). When specific data has been detected by the data detecting unit, the execution controlling unit performs control so as to cause the nozzle inspecting unit to operate for executing a nozzle inspection. Further, the maintenance unit operates for performing maintenance of the nozzles in accordance with a state of nozzles which has been detected through the nozzle inspection. In addition, in this embodiment, the execution controlling unit also performs control of the liquid ejecting unit and the transporting unit.

Next, operation of this embodiment, that is, printing operation of the liquid ejecting system 1, will be described with reference to flowcharts shown in FIGS. 3 and 4. In addition, this printing operation is started when the PC 12 (the inputting apparatus) is in a data-input waiting state and the printer 13 (the liquid ejecting apparatus) is in a pre-printing waiting state after a power-on operation.

As shown in FIG. 3, upon start of printing operation, at the PC 12 (the inputting apparatus) side, first, in step S21, data input processing for inputting data to the PC 12 is performed. This data input processing in step S21 is performed through a user's access, and various pieces of data are sequentially inputted. That is, first, for example, when a user inserts the recording medium 15 into the slot 16, processing for reading in a plurality of images (image data) is performed (step S21*a*). The read-in images are displayed on the display unit 17 of the PC 12 in the form of display images DT.

Next, processing for selecting a printing image a user desires to print out from among the plurality of read-in images is performed by, for example, allowing the user to perform a data inputting operation using the operation keys 18 while viewing the display images DT (step S21*b*). Further, printing condition setting processing for setting printing conditions (a total number of print sheets, a size, a kind of print paper, and the like) which are included in a specification of an ejection target medium with respect to the selected printing image is performed by allowing the user to perform a data inputting operation using the operation keys 18 similarly thereto (step S21*c*). In addition, in the data input processing in step S21, one or more ones of processes (such as a trimming process, a date indication selection process, a brightness adjustment process and a chromaticness adjustment process) may be additionally performed.

Here, the printer 13 performs the following processing concurrently with the data input processing (step S21). That is, in step S25, processing for determining whether or not the input data having been inputted in the data input processing is specific data which is other than liquid ejection data for use in ejecting inks corresponding to images to be formed on the print paper P (the ejection target medium) from the liquid ejecting head 26, and which is determined in advance as data for prompting a nozzle inspection (an ejection inspection) is performed (the specific data detecting process). In this embodiment, for example, image data which is read in from the recording medium 15 having been inserted into the slot 16 is handled as the specific data. Further, as a result of the determination in step S25, in the case where the input data is the specific data, that is, the image data, subsequently, in step S26, printing preparation command transmitting processing is performed and the process flow proceeds to step S22. That is, a preparation command is transmitted from the PC 12 side to the printer 13 side.

Next, as final processing in the data input processing (step S21), printing allowance/non-allowance selection processing for selecting whether or not the selected printing image may be printed under the printing conditions having been set is performed (step S21*d*). The printing allowance/non-allowance selection is made by allowing a user to perform a data input operation using the operation keys 18. At this time a printing allowance/non-allowance selection signal indicating a result of the printing allowance/non-allowance selection processing in step S21*d* is transmitted from the PC 12 side to the printer 13 side.

In subsequent step S22, processing for determining whether printing is allowed or not allowed is performed on the basis of the selection result with respect to the allowance or non-allowance of printing. As a result of the determination, in the case where the printing is not allowed, the process flow returns to an input waiting state prior to step S21. Thus, the user can reattempt, for example, the selection of a printing image and the setting of the printing conditions from the beginning thereof. In contrast, in the case where the printing is allowed, the process flow proceeds to next step S23, and the liquid ejection data for use in ejecting inks corresponding to an image to be formed on the print paper P from the liquid ejecting head 26 is transmitted to the printer 13 (the data transmitting process). After the transmission thereof, the process flow returns to the input waiting state and the processing at the PC 12 side is terminated.

Next, at the printer 13 (the liquid ejecting apparatus) side, first, in step S31, it is determined whether or not the printing preparation command has been received. Further, when the printing preparation command transmitted from the PC 12 side has been received (step S31: YES), printing preparation processing is performed in subsequent step S32.

Figure 4:
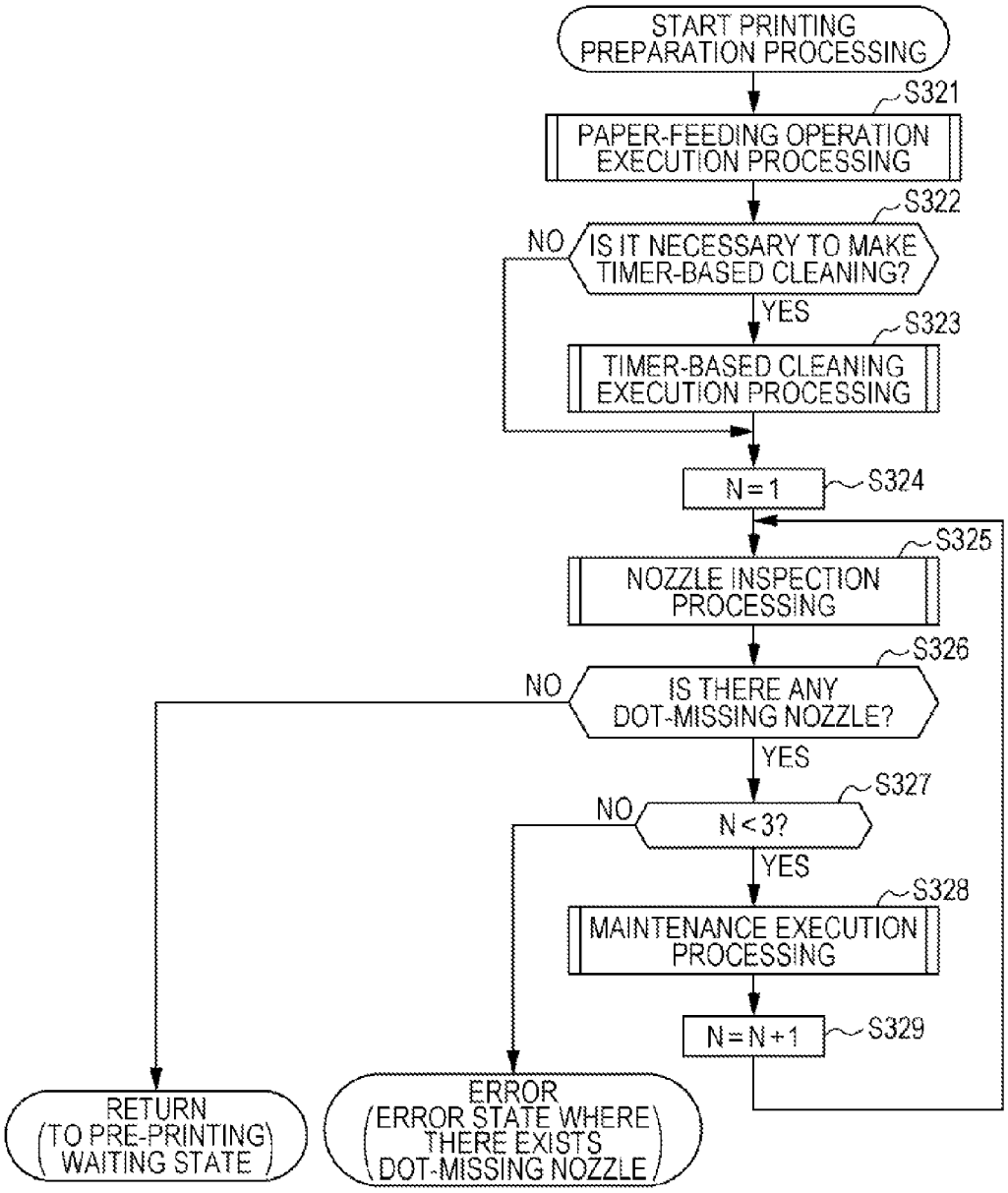
FIG. 4 is a flowchart illustrating printing preparation processing in a liquid ejecting apparatus according to an embodiment of the invention.

As shown in FIG. 4, when the printing preparation processing is started, processing for executing a paper feeding operation is performed in step S321. Here, in the printer 13, before printing is actually started, through the rotation operations of the transportation roller pair 33 and the ejection roller pair 34 which constitute the transporting unit, the print paper P is nipped and reciprocated between the liquid ejecting head 26 and the support stand 28 which constitute the transporting unit along the sub-scanning direction Y, and the edge of the print paper P at the sub-scanning direction Y side is set to a printing start position. That is, for example, in the case where the print paper P is roll paper, sometimes, through this reciprocation of the print paper P, paper powder having been adhered to the print paper P at the time of cutting of the print paper P is moved from the print paper P to the liquid ejecting head 26 and is adhered to the liquid ejecting head 26. Thus, processing is performed such that, after causing dust to be adhered to the liquid ejecting head 26 side by performing the paper feeding operation of the print paper P in advance of printing, a maintenance (cleaning) of the nozzles is performed. In this way, it is suppressed that dust, such as paper powder, adhered to the print paper P is adhered to the liquid ejecting head 26, and blocks the ejection of inks through the nozzles.

Next, in step S322, it is determined whether or not timer based cleaning is necessary. In the printer 13, a flag signal indicating that cleaning is necessary is stored in the control circuit of the printer 13 when an elapsed period of time from an immediately previously performed cleaning operation reaches a predetermined period of time. Further, in the case where the flag signal is stored in the control circuit (step S322: YES), the cleaning operation (the timer based cleaning) is performed by the maintenance unit (step S323), and in the case where the flag signal is not stored in the control circuit (step S322: NO), the cleaning operation is not performed by the maintenance unit, and the process flow proceeds to step S324.

In step S324, processing for setting a counter value N of a counter of the control circuit to "1" is performed, and subsequently, nozzle inspection processing is performed in step S325 (the nozzle inspecting process). Here, through the operation of the nozzle inspecting unit, an ejection inspection on each of the nozzles is performed, and thereby dot-missing nozzles each being incapable of ejecting ink droplets correctly are detected.

Next, in step S326, it is determined whether or not there exists any dot-missing nozzle, and in the case where there exists no dot-missing nozzle (step S326: NO), the printing preparation processing is terminated and the process flow returns to the pre-printing waiting state (returning). In contrast, in the case where there exists any dot-missing nozzle (step S326: YES), it is determined, in subsequent step S327, whether or not the counter value N is smaller than "3".

As a result of the determination processing in step S327, the counter value N is smaller than "3" (step S327: YES), maintenance execution processing is performed in subsequent step S328 (the maintenance process). In this maintenance, the same cleaning processing as the timer-based cleaning is performed on the liquid ejecting head. Further, after the completion of the maintenance, the counter value N is incremented by "1", and the process flow returns to the nozzle inspection processing in step S325. That is, the nozzle inspection processing in step S325 and the determination processing in step S326 for determining whether or not there exists any dot-missing nozzle are repeated again.

Next, in the case where, in the determination processing in step S327, it is determined that the counter value N is not smaller than "3" (step S327: NO), a current state is determined as an error state where there exists at least one dot-missing nozzle, and the printing preparation processing is terminated. That is, in this embodiment, as a state of the nozzles, in the case where there exists any dot-missing nozzle, the maintenance of the liquid ejecting head 26 (the nozzles thereof) is performed twice at most. In addition, in the printer 13 whose current state has been determined as the error state, maintenance processing necessary for at least one dot-missing nozzle is performed in different processing.

The process flow returns to the processing shown in FIG. 3, and in the printer 13 (the liquid ejecting apparatus), it is determined, in subsequent step S33, whether printing is allowed or not allowed. Here, the determination is made upon receipt of the printing allowance/non-allowance selection signal which indicates a result of the printing allowance/non-allowance selection processing, and which is transmitted from the PC 12 side to the printer 13 side in the printing allowance/non-allowance selection processing (step S21*d*). Further, in the case where the printing allowance/non-allowance selection signal is a signal indicating the allowance of printing (step S33: YES), printing processing is performed in subsequent step S34.

In this embodiment, the printer 13 performs printing by ejecting inks from the liquid ejecting head 26 onto the print paper P in the state of being transported on the support stand 28, on the basis of liquid ejection data transmitted in processing of step S23 at the PC 12 side. Accordingly, in the liquid ejecting system 11, after the completion of the maintenance execution processing (in step S38) in the printing preparation processing (in step S32), liquid ejection data transmission processing (in step S23) is performed.

In contrast, in the determination processing in step S33, in the case where the printing allowance/non-allowance selection signal transmitted from the PC 12 side to the printer 13 side is a signal indicating the non-allowance of printing (step S33: NO), printing processing is not performed and the process flow is returned to the pre-printing waiting state (returning). Further, the processing performed by the printer 13 is repeated again from the processing for receiving the printing preparation command (step S31).

The aforementioned embodiment brings about the following advantageous affects.

(1) It becomes possible to shorten a required time from the beginning of a user's access to the PC 12 (for example, a user's insertion of the recording medium 15 into the slot 16, or the like) until the beginning of ejection of inks in the printer 13, as compared with a case where the nozzle inspection is performed after the completion of transmitting the liquid ejection data to the printer 13.

(2) Even when there occurs a state where the ejection of inks through nozzles is blocked due to the transportation of the print paper P (for example, a state where paper powder or the like is adhered to the nozzles), it is possible to perform maintenance of such nozzles in the state incapable of ejecting inks onto the print paper P by performing the nozzle inspection after the completion of the transportation of the print paper P.

(3) The maintenance is performed during a period from the beginning of a user's access to the data inputting unit (the slot 16 and the operation keys 18) for inputting data in the PC 12 until the beginning of ejection of inks in the printer 13, and thus, it becomes possible to shorten a required time before the beginning of the ejection of inks, simultaneously with to eject inks correctly.

In addition, the aforementioned embodiment may be changed as follows.

In the printing operation of the aforementioned embodiment, before the maintenance execution processing (step S328) is performed at the printer 13 side, it may be detected at the PC 12 side whether or not the input data in the data input processing (step S21) is predetermined specific data. Further, preferably, in the case where specific data is detected under the state where there exist one or more dot-missing nozzles, the maintenance of the liquid ejecting head 26 is executed.

Next, printing operation in this modification example will be described with reference to FIG. 5. In addition, in FIG. 5, the same processes as those shown in FIG. 4 are denoted by the same step numbers as those of the processes shown in FIG. 4, and description thereof is omitted here.

Figure 5:
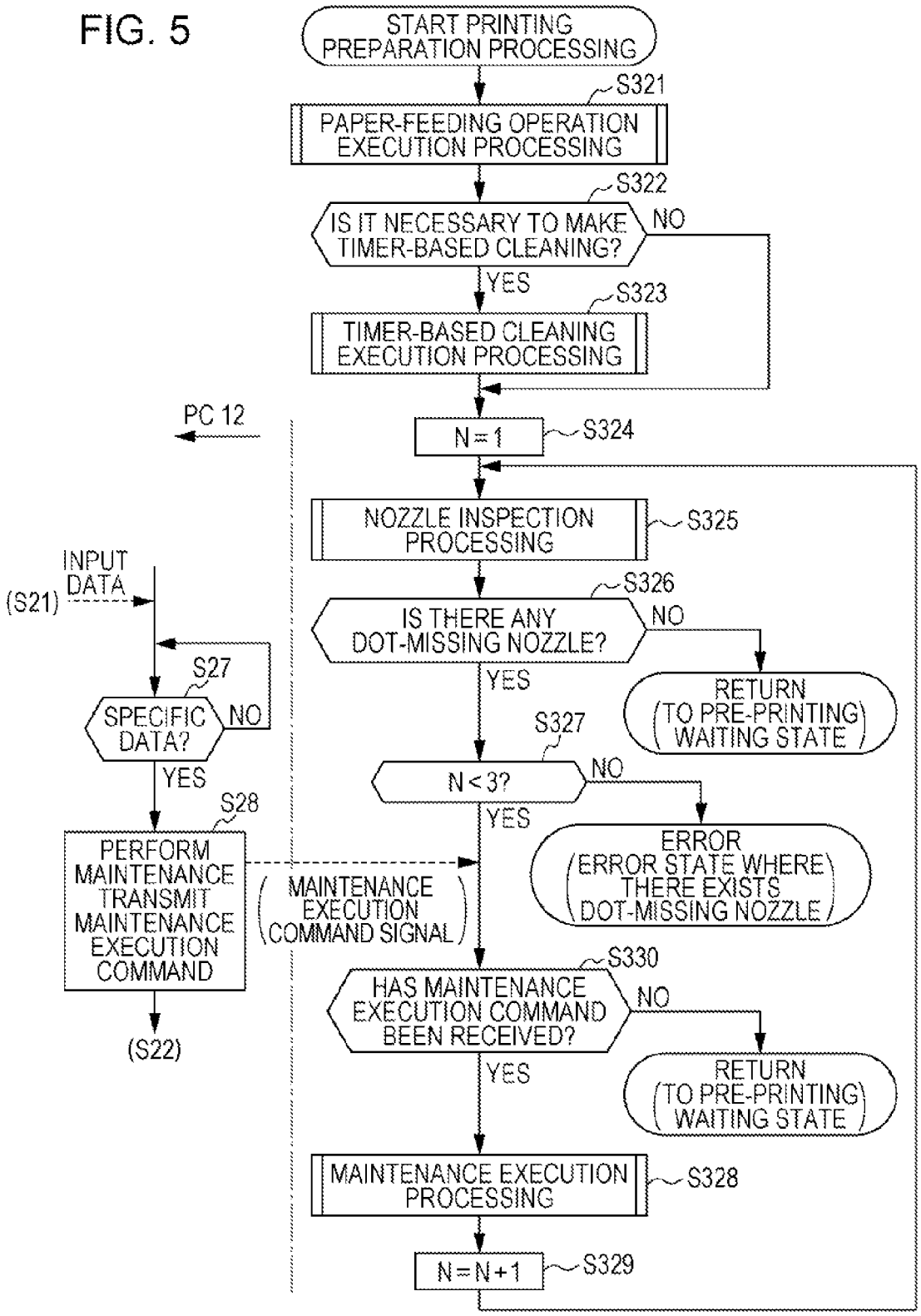
FIG. 5 is a flowchart illustrating processing for a case where, in printing preparation processing, a maintenance is performed upon receipt of designated data, in a modification example of an embodiment according to the invention.

As shown in FIG. 5, in this modification example, processing for determining whether or not input data having been inputted is designated data is performed in step S27 concurrently with data input processing (in step S21) at the PC 12 side (the designated data detecting process). In addition, the designated data is defined as data for which an execution probability that a user causes inks for image printing to be ejected onto the print paper P is relatively high among pieces of specific data which prompt a nozzle inspection. Incidentally, in this modification example, the designated data is data related to the total number of print sheets which is inputted in the printing condition setting processing.

Further, as a result of the determination processing in step S27, in the case where input data is the data related to the total number of print sheets (step S27: YES), maintenance execution command transmitting processing is performed in next step S28. Through this processing in step S28, a maintenance execution command is transmitted from the PC 12 side to the printer 13 side.

Meanwhile, at the printer 13 side, before the maintenance execution processing (step S328), determination processing for determining whether or not the maintenance execution command has been received is performed in step S330. Further, in the case where the maintenance execution command has been received (step S330: YES), the maintenance execution processing is performed in subsequent step S328. In addition, in the case where the maintenance execution command has not been received (step S330: NO), the total number of print sheets is zero and this means that a user does not intend to perform printing, so that the maintenance execution processing is not performed here and the process flow returns to the pre-printing waiting state (returning).

This modification example brings about the following advantageous effects in addition to the advantageous effects (1) to (3) of the aforementioned embodiment.

(4) The execution of a waste maintenance is suppressed by defining, as designated data, input data for which a probability that inks are actually ejected from the liquid ejecting head 26 onto the print paper P in the printer 13 is high and performing maintenance in the case where this designated data has been inputted. As a result, it becomes possible to reduce an amount of inks consumed in the maintenances.

In the aforementioned modification example, the designated data may be data related to an elapsed time from a time point when specific data has been detected at the PC 12 side (step S25: YES) until a time point which is determined in accordance with a state of nozzles having been inspected in the nozzle inspection processing at the printer 13 side (step S325).

Specifically, an elapsed time from a time point when specific data has been inputted is measured by a timer circuit provided in the control circuit of the PC 12. Further, in the case where the number of dot-missing nozzles is small, it is unnecessary to immediately perform maintenance, and it is deemed that any user spending a long period of time until the selection of the allowance or non-allowance of printing intends to perform printing, and thus, the designated data is set to data indicating a relatively long elapsed time. In contrast, in the case where the number of dot-missing nozzles is large, it takes a large amount of time to complete the maintenance execution processing (step S328), and thus, the designated data is set to data indicating a relatively short elapsed time.

This modification example brings about the following advantageous effects in addition to the advantageous effects (1) to (4) of the aforementioned embodiments.

(5) In view of, for example, a situation in which, in the case where the number of nozzles each incapable of ejecting an ink is small, it is unnecessary to immediately perform the maintenance, or the like, the maintenance is performed after an elapsed time which is determined in accordance with a state of nozzles which has been detected through the nozzle inspection. Accordingly, it becomes possible to reduce an amount of inks consumed in the maintenances.

In the liquid ejecting system 11 according to the aforementioned embodiment, the timing of the execution of the liquid ejection data transmission processing (step S23) is not necessary after that of the execution of the maintenance execution processing (step S328). For example, in the case where the maintenance of the liquid ejecting head 26 (the nozzles thereof) is performed through cleaning processing which needs a large amount of time depending on a state of the nozzles, the transmission of the liquid ejection data may be performed regardless of the execution of the maintenance. In this case, preferably, a configuration is made such that the transmitted liquid ejection data is temporarily stored and retained at the printer 13 side until the completion of the maintenance processing, and further, printing is performed immediately after the completion of the maintenance processing.

In the aforementioned embodiment, preferably, the maintenance execution processing in the printer 13 (step S328 in FIG. 5) is made maintenance processing whose content accords to a state of the nozzles. For example, a configuration may be made such that, in the case where the number of dot-missing nozzles is small, such as around one to ten, a period of suction performed by the cap 36 is made short; while, in the case where the number of dot-missing nozzles is large, such as larger than or equal to several tens, a period of suction performed by the cap 36 is made large.

In the liquid ejecting system according to the aforementioned embodiment, in the case where the non-allowance of printing is selected in the printing allowance/non-allowance selection processing (step S21*d*), a history of processing having been performed in the printing preparation processing (step S32) of the printer 13 may be recorded as a printing preparation history. For example, an inspection date and time, the presence or absence of a dot-missing nozzle (a state of nozzles) and the like in the nozzle inspection processing (step S325) are recorded. Further, in printing preparation processing to be performed this time, the content of an execution of the nozzle inspection processing may be set with reference to a previously recorded printing preparation history.

In the aforementioned embodiment, the print paper P is not necessarily transported between the liquid ejection head 26 and the support stand 28 before the nozzle inspection processing (step S325). For example, in the case where the print paper P is not role paper but a single-cut sheet, any paper powder due to cutting is not generated, and thus, the nozzles are unlikely to be affected by paper powder or the like. Further, in the printing preparation, the print paper P is transported to a printing preparation position without passing below the liquid ejecting head 26, and thus, the paper powder is unlikely to move to the liquid ejecting head 26.

In the aforementioned embodiment, the printing allowance/non-allowance selection (step S21*d* in FIG. 3) may be made by a means other than a user's data input using the operation keys 18. For example, the printing allowance/non-allowance selection may be made by recognition of fee-charging for printing. That is, for example, the allowance of printing may be selected by allowing a user to insert coins into a coin insertion slot (not illustrated) which is provided in the inputting apparatus (the PC 12). Further, the configuration may be made such that, when the allowance of printing has been selected, a receipt indicating fee-charging is outputted from an outputting unit (not illustrated) which is provided in the inputting apparatus (the PC 12). In addition, preferably, such a configuration is employed in a kiosk terminal.

In the aforementioned embodiment, the specific data may be input data other than image data. For example, the specific data may be input data in the printing image selection processing (step S21*b*) or input data in the printing condition setting processing (step S21*c*). Further, for example, the nozzle inspection may be performed by regarding, as input data, an event in which a user touches the operation keys 18 or the display unit 17 of touch panel type in a kiosk terminal (an inputting apparatus), and determining this input data as the specific data.

In the aforementioned embodiment, the designated data may be data other than the data indicating the total number of print sheets, having being inputted in the printing condition setting processing as data for use in setting of a specification of an ejection target medium. That is, the maintenance may be performed by defining, as the designated data, data inputted in different processing on a printing image, such as processing for setting the size and kind of print paper, trimming processing, date indication selecting processing, brightness adjustment processing or chromaticness adjustment processing.

In the aforementioned embodiment, the configuration may be made such that the timer-based cleaning is not performed during the printing preparation processing, and upon power-on of the printer 13, processing for determining whether or not the timer-based cleaning (step S322) is needed is performed. Further, as a result of the determination, in the case where a flag signal is stored in the control circuit (step S322; YES), the maintenance unit may make cleaning (the timer-based cleaning).

In the aforementioned embodiment, the liquid ejecting head 26 is not limited to a so-called serial-head type ejecting head which ejects liquids while reciprocating together with the carriage 22 in a direction intersecting with a transportation direction of the print paper P (i.e., the sub-scanning direction Y). That is, the liquid ejecting head 26 may be a line-head type ejecting head which forms a whole shape in which the length size thereof corresponds to the width size of the print paper P, and which, under the state where the longitudinal direction thereof is fixedly disposed along the width direction of the print paper P, which intersects with the transportation direction of the print paper P, ejects liquids onto a medium through a plurality of nozzles which is provided so as to be across an approximately whole of the longitudinal direction thereof.

In the aforementioned embodiment, supply sources of inks, that is, liquids ejected from the liquid ejecting head 26, may be ones other than the ink cartridges 27 of so-called on-carrier type which are attached to the carriage 22. For example, the supply sources of inks may be ink containers of so-called off-carrier type which are provided at a position which is located inside the apparatus body 19 of the printer 13 and which is other than the position of the carriage 22. Alternatively, the supply sources of inks may be ink containers of so-called external-attachment type which are provided outside the apparatus body 19. In this way, in the case where ink containers provided outside the carriage 22 are used, a storage capacity of each of inks can be made larger, as compared with the case where there are used the ink cartridges 27 for each of which there is a restriction in its ink storage capacity because the cartridge 27 is of a type attached to the carriage 22.

In addition, in the case where the liquid ejecting head 26 inside the apparatus body 19 is fed with inks from the ink containers provided outside the apparatus 19, it is necessary to rout ink feeding tubes for feeding the inks from the outside to the inside of the apparatus body 19. Thus, preferably, holes and notches, into which the ink feeding tubes can be inserted, are provided in the apparatus body 19. Alternatively, the ink feeding tubes may be routed from the outside to the inside of the apparatus body 19 by being passed through a gap formed by restriction members, such as bosses, which cause opening/closing objects, such as a scanner unit and a cover, which are provided in the apparatus body 19 so as to be openable/closable, not to be completely closed onto the apparatus body 19. In this way, feeding of inks to the liquid ejecting head 26 can be easily achieved by using ink flow paths inside the ink feeding tubes.

In the aforementioned embodiment, the ejection target medium is not limited to the print paper P, and can be arbitrarily selected from among a film, a metallic film, a plate material, a sticker, fabric, Western-style clothing, such as T-shirt, Japanese-style clothing, such as kimono, a threedimensional object, and the like, provided that the selected object can be transported by the transporting unit.

In the aforementioned embodiment, the printer 13 may be a liquid ejecting apparatus for spraying or ejecting liquids other than inks. In addition, when a liquid is ejected from a liquid ejecting apparatus in the form of minute liquid droplets, the minute liquid droplets include grain-shaped droplets, teardrop-shaped droplets and trailing-string-shaped droplets. Further, as the liquid mentioned above, any material capable of being ejected from a liquid ejecting apparatus can be employed. For example, any substance in the state of being in a liquid phase can be used, and such substances include high-viscosity or low-viscosity liquid objects, sol, gel water, other organic solvents, inorganic solvents, solutions, liquid resins, and fluid objects, such as liquid metals (metallic melts). Further, not only a liquid as one of states of a substance, but also an object obtained by dissolving, dispersing or mixing particles of a functional material made of a solid, such as a pigment or a metallic particle, into a solvent, or the like, is included. As representative examples of the liquid, ink such as described in the aforementioned embodiment, liquid crystal and the like can be given. Here, the ink encompasses aqueous ink and oil-based ink, which are commonly used, as well as various liquid constituents, such as gel ink and hot-melt ink. As specific examples of the liquid ejecting apparatus, there can be given, for example, a liquid crystal display, an electroluminescence (EL) display, and a plane emission display, as well as a liquid ejecting apparatus for ejecting a liquid which includes a material, such as an electrode material or a color material, for use in manufacturing of color filters, and the like, in the form of dispersion or dissolution. Further, the liquid ejecting apparatus may be a liquid ejecting apparatus for ejecting a living organic material for use in manufacturing of biotips, a liquid ejecting apparatus for ejecting a liquid which is used as a precise pipet and becomes a sample, a print apparatus, a micro dispenser, or the like. Moreover, the liquid ejecting apparatus may be a liquid ejecting apparatus for ejecting, in a pinpoint manner, lubricating oil onto precision machines, such as a watch and a camera, or a liquid ejecting apparatus for ejecting a transparent resin liquid, such as an ultraviolet hardening resin liquid, for use in forming a minute hemispheric lens (optical lens) used in optical communication elements and the like, onto a substrate. Further, he liquid ejecting apparatus may be a liquid ejecting apparatus for ejecting an acid or alkaline etching liquid for use in etching of a substrate or the like.

The entire disclosure of Japanese Patent Application No. 2013-155349, filed Jul. 26, 2013 is expressly incorporated by reference herein.

What is claimed is:

1. A control method for a liquid ejecting system provided with a liquid ejecting apparatus including a liquid ejecting portion that includes a plurality of nozzles through each of which a liquid is ejected, a nozzle inspecting portion that performs an ejection inspection for inspecting whether or not the nozzles are in a state capable of ejecting liquid droplets correctly, and a maintenance portion that performs maintenance of the nozzles, and an inputting apparatus including a data inputting portion through which data can be inputted, the control method comprising:

a specific data detecting process that detects whether or not input data inputted to the data inputting portion of the inputting apparatus is specific data which is other than liquid ejection data for causing a liquid corresponding to an image to be formed on an ejection target medium to be ejected from the liquid ejecting portion, the specific data being other than data in accordance with operation history of the liquid ejecting apparatus, and the specific data being determined in advance as data for prompting the ejection inspection;

a data transmitting process that transmits liquid ejection data for causing the liquid to be ejected on the ejection target medium, from the inputting apparatus to the liquid ejecting apparatus;

a nozzle inspecting process that, in the case where the specific data is detected in the specific data detecting process, causes the nozzle inspecting portion to perform the ejection inspection; and a maintenance process that, in accordance with a state of the nozzles which is detected in the nozzle inspecting process, causes the maintenance portion to perform maintenance of the nozzles, wherein the maintenance process is initiated before the liquid ejection data is transmitted from the inputting apparatus to the liquid ejecting apparatus by the data transmitting process.

2. The control method for a liquid ejecting system, according to claim 1, further comprising:

a designated data detecting process that detects whether or not input data inputted to the data inputting portion is designated data which is determined in advance as data for which a probability that the liquid for use in forming the image on the ejection target medium is ejected from the liquid ejecting portion is relatively high among a plurality of pieces of specific data including the specific data, wherein, in the case where the designated data is detected in the designated data detecting process, the maintenance process is performed.

3. The control method for a liquid ejecting system, according to claim 2, wherein the designated data is data for use in setting a specification of the ejection target medium.

4. The control method for a liquid ejecting system, according to claim 2, wherein the designated data is elapsed time data which indicates an elapsed time from a time point when the specific data is detected, and which is determined in accordance with a state of the nozzles inspected in the nozzle inspecting process.

5. The control method for a liquid ejecting system, according to claim 1, further comprising a medium transporting process that, before the nozzle inspecting process is performed, causes a transporting portion, which is further included in the liquid ejecting apparatus and which transports an ejection target medium onto which the liquid ejecting portion ejects the liquid, to transport the ejection target medium.

6. The control method for a liquid ejecting system, according to claim 1, wherein performance of the maintenance process before the data transmitting process shortens a required time from the beginning of a user's access to a computer to which the liquid ejecting system is connected, until a time when ink is ejected from the nozzles, as compared with a case where the nozzle inspection is performed after the data transmitting process.

7. The control method for a liquid ejecting system, according to claim 1, wherein the specific data detecting processing is performed concurrently with data input processing of the input data, at the inputting apparatus, to generate the liquid ejection data.

8. The control method for a liquid ejecting system, according to claim 1, wherein the specific data detecting processing is performed when a storage medium containing input data is mounted to the inputting apparatus to input the input data to the data inputting portion of the inputting apparatus.

9. The control method for a liquid ejecting system, according to claim 1, wherein the specific data is image data.

10. The control method for a liquid ejecting system, according to claim 1, wherein the specific data detecting processing and the data transmitting processing are performed in a state in which the liquid ejecting portion is opposed to the maintenance portion.

11. A liquid ejecting system comprising:

a liquid ejecting apparatus that includes a liquid ejecting portion including a plurality of nozzles through each of which a liquid is ejected, a nozzle inspecting portion that inspects whether or not the nozzles are in a state capable of ejecting liquid droplets correctly, and a maintenance portion that performs maintenance of the nozzles;

an inputting apparatus that includes an inputting portion through which data can be inputted; and a controlling apparatus that includes:

a data detecting portion that detects whether or not input data inputted to the data inputting portion is predetermined specific data, the specific data being other than data in accordance with operation history of the liquid ejecting apparatus, and the specific data being determined in advance as data for prompting the ejection inspection; and an execution control portion that, in the case where the data detecting portion detects the specific data, causes the nozzle inspecting portion to perform an inspection, and causes the maintenance portion to perform maintenance of the nozzles in accordance with a state of the nozzles which is detected by the nozzle inspecting portion, wherein the maintenance of the nozzles is initiated by the maintenance portion prior to a time that liquid ejection data is transmitted from the inputting apparatus to the liquid ejecting apparatus.

12. The liquid ejecting system, according to claim 11, wherein performance of the nozzle maintenance before the liquid ejection data is transmitted to the liquid ejecting apparatus shortens a required time from the beginning of a user's access to a computer to which the liquid ejecting system is connected, until a time when ink is ejected from the nozzles, as compared with a case where the nozzle maintenance is performed after the data transmitting process.

13. The liquid ejecting system, according to claim 11, wherein maintenance of the nozzles based on the operation history that the liquid ejecting apparatus stores is performed before the inspection by the nozzle inspecting portion.

14. A control method for a liquid ejecting system provided with a liquid ejecting apparatus including a liquid ejecting portion that includes a plurality of nozzles through each of which a liquid is ejected, a nozzle inspecting portion that performs an ejection inspection for inspecting whether or not the nozzles are in a state capable of ejecting liquid droplets correctly, and a maintenance portion that performs maintenance of the nozzles, and an inputting apparatus including a data inputting portion through which data can be inputted, the control method comprising:

a specific data detecting process that detects whether or not input data inputted to the data inputting portion by a user of the inputting apparatus is specific data which is other than liquid ejection data for causing a liquid corresponding to an image to be formed on an ejection target medium to be ejected from the liquid ejecting portion, the specific data being other than data in accordance with operation history of the liquid ejecting apparatus, and the specific data being determined in advance as data for prompting the ejection inspection;

a data transmitting process that transmits liquid ejection data for causing the liquid to be ejected on the ejection target medium, from the inputting apparatus to the liquid ejecting apparatus;

a nozzle inspecting process that, in the case where the specific data is detected in the specific data detecting process, causes the nozzle inspecting portion to perform the ejection inspection; and a maintenance process that, in accordance with a state of the nozzles which is detected in the nozzle inspecting process, causes the maintenance portion to perform maintenance of the nozzles, wherein the maintenance process is initiated before the liquid ejection data is transmitted from the inputting apparatus to the liquid ejecting apparatus by the data transmitting process.

* * * * *